US006481123B1

(12) United States Patent
Kanzler et al.

(10) Patent No.: US 6,481,123 B1
(45) Date of Patent: Nov. 19, 2002

(54) TRACK MAINTENANCE DEVICE

(75) Inventors: Helmut Kanzler, Vöhringen; Gerd Friedmann, Ulm, both of (DE)

(73) Assignee: Kassbohrer Glandefahrzeug AG (DE)

( * ) Notice: Subject to any disclaimer, the term of this patent is extended or adjusted under 35 U.S.C. 154(b) by 0 days.

(21) Appl. No.: 09/582,865

(22) PCT Filed: Dec. 18, 1998

(86) PCT No.: PCT/EP98/08322

§ 371 (c)(1),
(2), (4) Date: Aug. 11, 2000

(87) PCT Pub. No.: WO99/35338

PCT Pub. Date: Jul. 15, 1999

(30) Foreign Application Priority Data

Dec. 31, 1997 (DE) ..... 297 23 018 U

(51) Int. Cl.[7] ..... E01H 4/00
(52) U.S. Cl. ..... 37/223; 37/242
(58) Field of Search ..... 37/219, 220, 221, 37/222, 223, 224, 225, 242; 172/540, 554, 518, 45, 49

(56) References Cited

U.S. PATENT DOCUMENTS 3,794,122 A * 2/1974 Rohrer ..... 172/66
3,878,900 A * 4/1975 Boisse et al. ..... 172/145
4,056,328 A * 11/1977 Maxey ..... 404/96
4,337,586 A * 7/1982 Buono ..... 37/222
4,359,831 A * 11/1982 Beeley ..... 37/258
4,523,398 A * 6/1985 Scheibel et al. ..... 37/220
4,860,465 A * 8/1989 Brandt ..... 37/221
5,077,919 A * 1/1992 Sinykin ..... 37/219
5,343,960 A * 9/1994 Gilbert ..... 172/823
5,659,984 A * 8/1997 Haug ..... 37/219
5,809,671 A * 9/1998 Sinykin ..... 37/219
5,930,743 A * 7/1999 Warren ..... 702/166
6,026,600 A * 2/2000 Lela ..... 37/219

* cited by examiner

*Primary Examiner*—Victor Batson
(74) *Attorney, Agent, or Firm*—Dick and Harris

(57) ABSTRACT

The invention relates to a snow grooming device, which can be attached to a tool carrier in the front or back of a snow grooming vehicle and which is provided with a snow conditioning tool that can be coupled to the tool carrier, and with a tiller unit on the same side of the vehicle. To create a better application potential for conditioning the snow base with this snow grooming device, in spite of its simple design and simple operation, it is suggested according to the invention that the tiller unit is designed as an exchangeable adapter separate from the conditioning tool, and that it can be separately coupled to and uncoupled from the vehicle.

10 Claims, 9 Drawing Sheets

TRACK MAINTENANCE DEVICE

BACKGROUND OF THE INVENTION

1. Field of the Invention

The invention relates to a snow grooming device, which can be attached to a tool carrier in the front or back of a snow grooming vehicle and which is provided with a snow conditioning tool that can be coupled to the tool carrier, and with a tiller unit on the same side of the vehicle.

2. Background of the Invention

From PCT/EP95/04233, a snow grooming device of this category is known in which the tiller unit is fastened in the area of the lower rear edge of a dozer blade mounted in front of the vehicle. The tiller teeth of the tiller unit are pivotably held in bearing supports which are rigidly mounted at the bottom rear edge of the dozer blade. The tiller teeth can be tilted—via a control mechanism supported at the dozer blade—from a ready position into an operating position in which the teeth engage in the snow base.

This tiller unit has proven very successful in practical application. It can be used to rip open and loosen the snow base. The snow grooming vehicle that follows comminutes the ripped-up chunks and may treat them with conditioning tools that follow behind. Thus, even hard, icy snow surfaces can be reconditioned into a new loose base.

SUMMARY OF THE INVENTION

The objective of the invention is to improve a snow grooming device of the above mentioned type in such a way that an improved application potential is created for the conditioning of the snow base, while the device should be of simple design and easy to operate.

This objective is achieved according to the invention with a snow grooming device which has the characteristics outlined in claim 1.

Thus, the tiller unit can be provided separately from the conditioning tool and be attached to the vehicle as an exchangeable adapter. The tiller unit can be designed as a separate unit and can therefore be very well adapted to the desired function.

For example, the tiller unit can be attached to the vehicle itself as an exchangeable adapter, and uncoupled again. As an adapter, it is separately exchangeable, so that the vehicle can be equipped according to the desired mode of operation.

Preferably, it is possible to couple the tiller unit to the tool carrier. Thus, the tiller unit itself can be coupled directly to the tool carrier as an adapter.

In an alternate version of the invention, the conditioning tool or the tiller unit can be coupled directly to the tool carrier. Thus, for example, the conditioning tool can, as an alternative to the tiller unit, be directly attached to the tool carrier. Another possible version would be for the tool carrier to have two carrier units to which the conditioning tool and the tiller unit could be attached independently of each other and coupled side by side to a carrier unit.

Advantageously, the tiller unit can be arranged between the conditioning tool and the tool carrier. Thus, the tiller unit and the conditioning tool work in succession in driving direction and can supplement each other for optimal grooming. For example, the tiller unit can first loosen the base with tiller teeth, and then the ripped-up chunks can be comminuted further with the conditioning tool until they have the desired consistence.

It is recommended that the tiller unit be designed as a holder for the conditioning tool. This means that the conditioning tool can be held by the tiller unit, allowing it, for example, to be coupled and uncoupled while it is on the vehicle. Thus, the tiller unit and the conditioning tool can be designed as a compact unit. By designing the tiller unit as an exchangeable adapter, it serves as a coupling unit for the tool carrier.

It is also conceivable for the coupling connection of the tiller unit for the tool carrier to correspond to the coupling connection of the conditioning tool for the tool carrier. In that way, the tiller unit and the conditioning tool can be arranged on the tool carrier, as an alternative. This allows the exchangeable coupling of the tiller unit and the conditioning tool to the tool carrier.

As a particularly advantageous alternative, the tiller unit can be provided with a coupling connection for the tool carrier on the side facing the vehicle, and a holding arrangement for the conditioning tool on the side facing away from the vehicle. This means that the tiller unit is attached to the tool carrier, while as an option, the conditioning tool can be attached to the holding arrangement. Thus, the tiller unit can be coupled to the tool carrier alone, or, in addition to the tiller unit, the conditioning tool can be attached and held by the carrier.

In a special manner, the tiller teeth of the tiller unit can be made to move—via a control mechanism—between a ready position and an operating position in which the teeth engage in the snow base, whereby the control mechanism is integrated in the tiller unit. Thus, the control mechanism is always coupled and uncoupled together with the tiller unit, which is designed as an exchangeable adapter, so that the control mechanism can be operated more or less independently from any accessories. Naturally, the control mechanism is supplied with energy from the energy connections, such as the hydraulic lines, the accessories or the vehicle itself.

Preferably, the control mechanism can be linked to an actuator lever that is separate from the tiller teeth. The actuator lever can be optimally designed for activating the teeth and can be appropriately adapted to the control mechanism. The design can also be such that the control mechanism and the actuator lever are arranged at an adequate distance from the snow base that is to be conditioned.

DESCRIPTION OF THE PREFERRED EMBODIMENT

In a preferred embodiment, the control mechanism can be provided with a piston and cylinder unit whose linkage points are on the tiller unit. Thus, the piston and cylinder unit is supported by the tiller unit, so that the exchangeable adapter can be coupled and uncoupled without regard to any connection requirements for the control mechanism.

It is also conceivable that several tiller teeth of the tiller unit are connected with each other via a laterally extending cross web which engages in the snow base when the teeth are in operating position. The cross web serves as an additional separation and ripping arrangement. In operating position, it separates a layer of the snow base, which is then easy to comminute and condition. Furthermore, the cross web facilitates the additional loosening of the material to be conditioned.

It is understood that the tiller teeth can be designed as a holding arrangement for the cross web, and just a few tiller teeth are enough for this holding function. It is also understood that the conditioning function of the cross web does not primarily depend on the tiller unit being designed as an exchangeable adapter.

It is recommended that the cross web be arranged on the exterior end of the tiller teeth. This means that a layer of the snow base in the sector between the tiller teeth and their linkage point on the tiller unit is lifted up.

It is also conceivable for the cross web to extend parallel to one of the swivel axes of the tiller teeth.

In a practical embodiment, the cross web can tilt upward and toward the rear of the snow grooming device, when the tiller teeth are in operating position. In this sense, "tilt upward" means that the web extends laterally in relation to the horizontal plane, that is to say in a skyward direction. Due to this direction of the cross web, the separated snow layer is lifted slightly upward and is thus additionally loosened up. In some snow layers, this already causes a slight breaking of the layer. Naturally it is also possible for only a part of the cross web to tilt upward.

Preferably, the cross web can be provided with a web section which in the front is substantially horizontal when the tiller teeth are in operating position, and whose back is formed by a winged web section that tilts upward. First, one layer of snow is separated by the horizontal web section. The winged section of the web slightly lifts this layer at an upward angle and loosens it. Thus, the functions of separating, lifting and loosening the snow are each performed optimally by different sections of the web.

It is recommended that a knife blade be provided at the front of the cross web. The knife blade facilitates the cutting of a snow layer.

Preferably, the tiller teeth can be chamfered to approximately knife-edge shape in the front. This facilitates the ripping-up of the snow base.

In a variant of the invention, the conditioning tool is a dozer blade. Thus, the tiller unit can be designed as an exchangeable adapter separate from the dozer blade. Usually, the dozer blade is attached to the front of a snow grooming vehicle. As mentioned above, the tiller unit can be coupled on separately as an exchangeable adapter.

It can be especially advantageous if the conditioning tool is an auger. Often, augers are attached and are pulled behind a snow grooming vehicle. By designing the tiller unit as an exchangeable adapter, it can be provided separately from the auger. For example, the tiller unit can be in front of the auger, where it first rips open the snow base in coarse chunks and loosens it, while the chunks are then conditioned by the auger.

It is understood that the objective according to the invention can also be solved by a snow grooming vehicle with a snow grooming device according to claim 1. Correspondingly, the snow grooming vehicle can also contain the above described characteristics of the sub-claims.

DESCRIPTION OF THE PREFERRED EMBODIMENT

Figure 1:
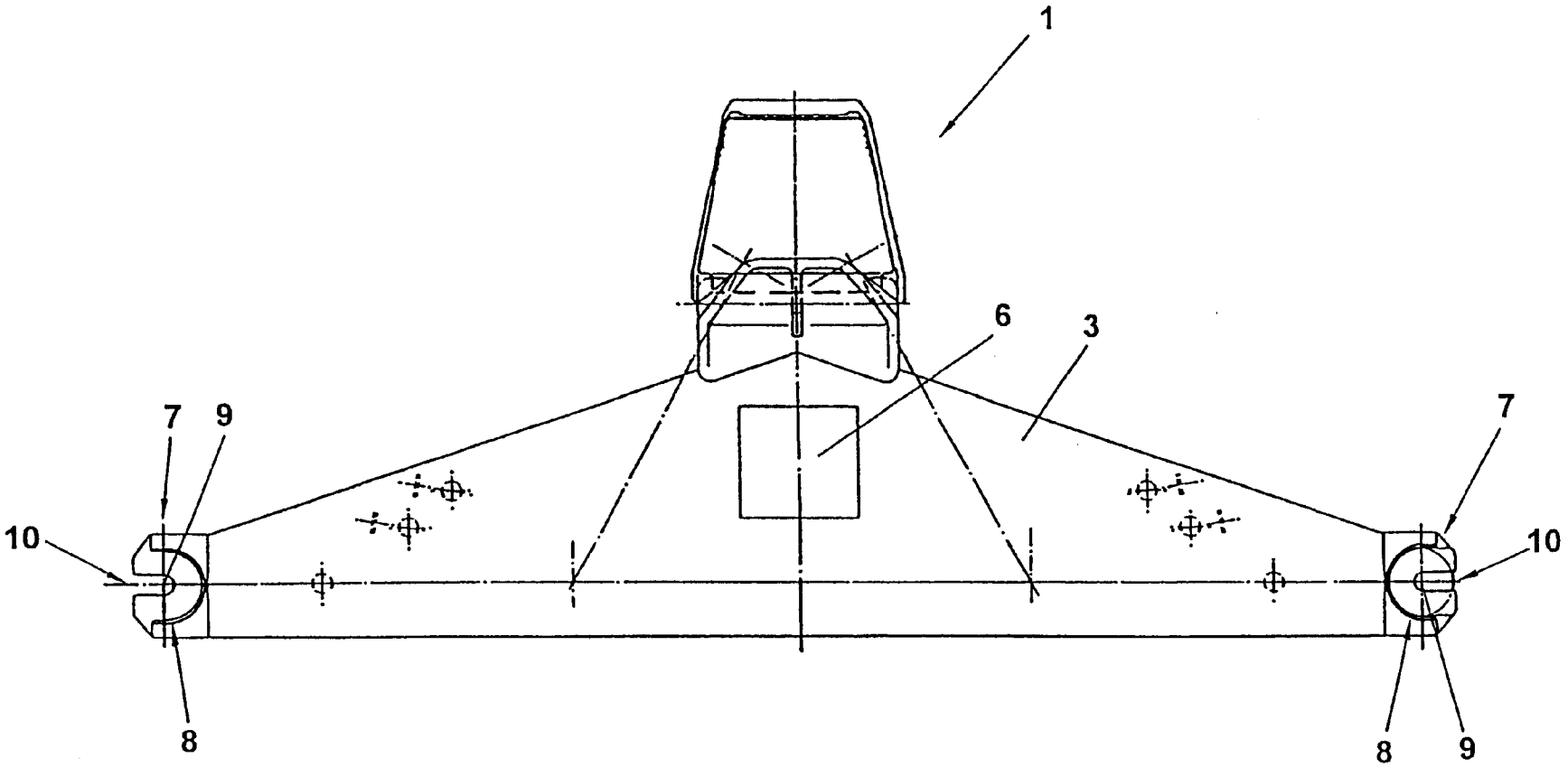
FIG. 1 shows a frontal view of a snow grooming vehicle according to the invention in accordance with a first embodiment.
Figure 2:
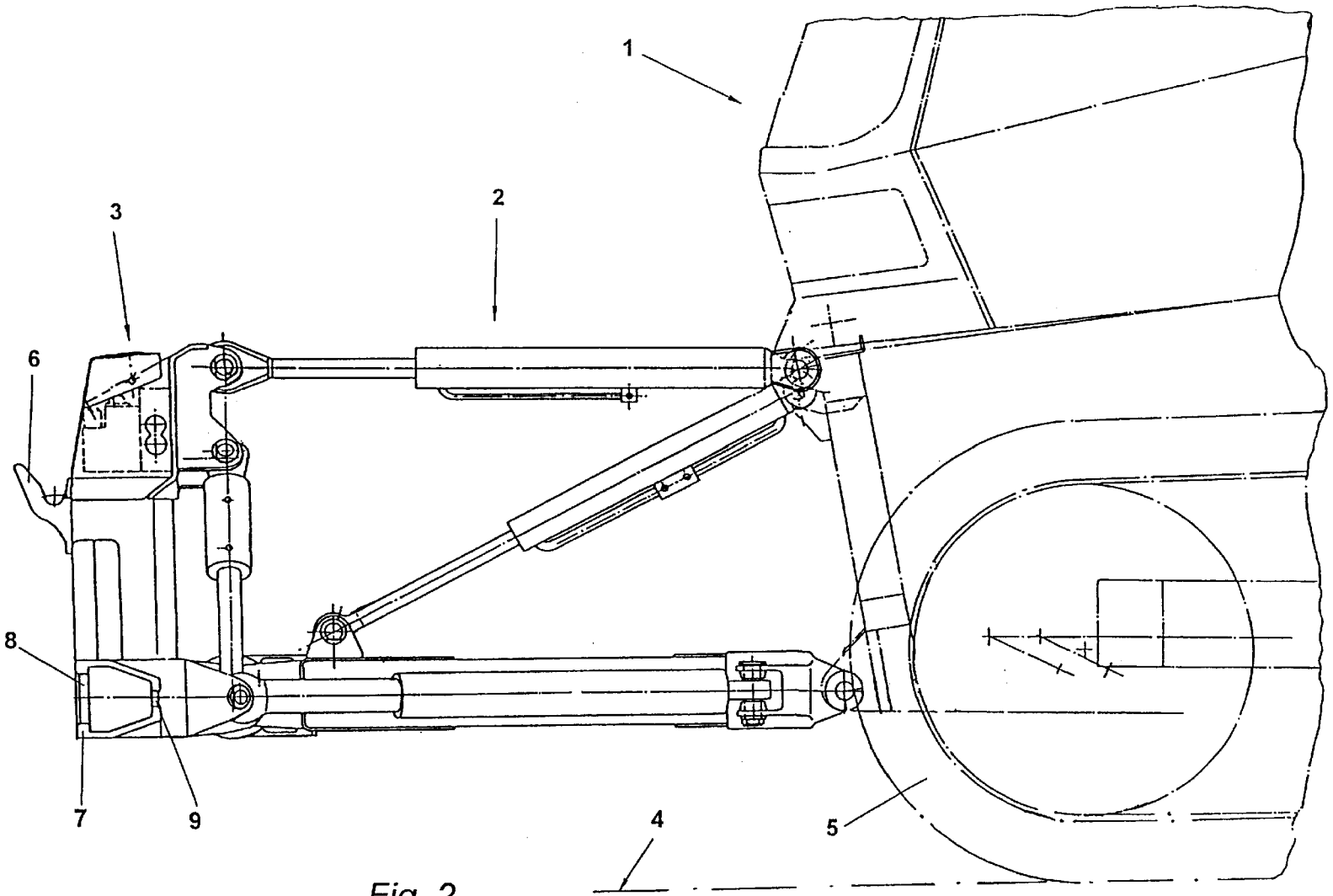
FIG. 2 shows a lateral view of the front part and the snow grooming vehicle shown in FIG. 1.

FIGS. 1 and 2 show a snow grooming vehicle 1 according to a first embodiment of the invention, showing a multi-articulated mounting 2, to which a tool carrier 3 is attached in the front.

Vehicle 1 runs on a snow base 4, is designed as a tracked vehicle and is therefore running on tracks 5.

The multi-articulated mounting 2 can move on all sides via several piston and cylinder units, as is known in conventional dozer blade mountings. The tool carrier 3 moves by following the movements of multi-articulated mounting 2.

Tool carrier 3 consists of a three-point bearing whose three bearing points are approximately at the corners of an isosceles triangle. The vertex is formed by a hook 6 pointing skyward. The two base points are formed by locating receptacles 7 which are provided at the outer corner points and whose cross section is roughly pot-shaped. In the front, they have a locating hole 8 and in the back of the pot shape a hole 9. Locating holes 8 have a larger diameter than hole 9. Each locating receptacle 7 has a cut 10 on the outside, extending to the centre of locating hole 8 or hole 9.

Figure 3:
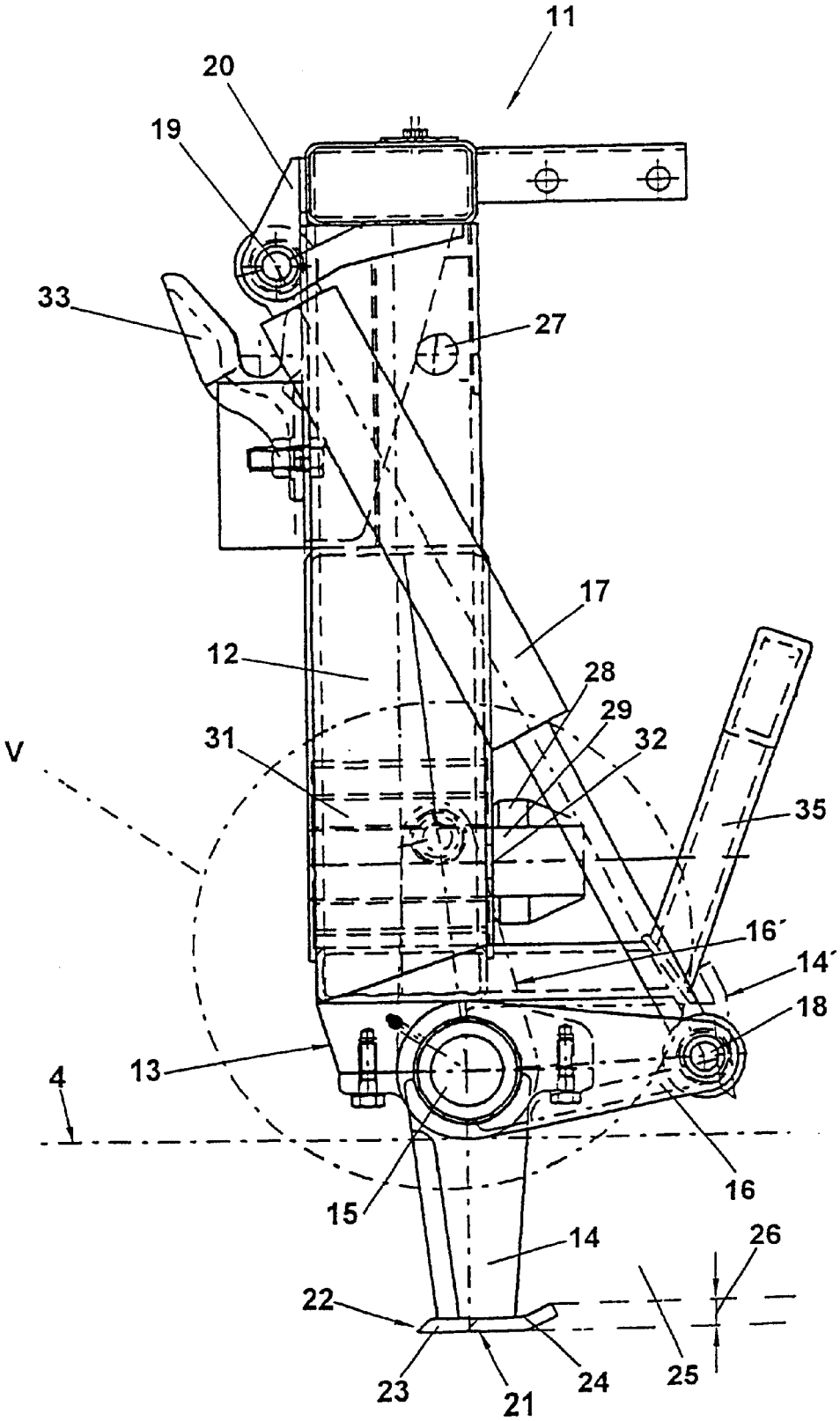
FIG. 3 shows a lateral view of an exchangeable adapter according to the invention in accordance with the first embodiment.
Figure 4:
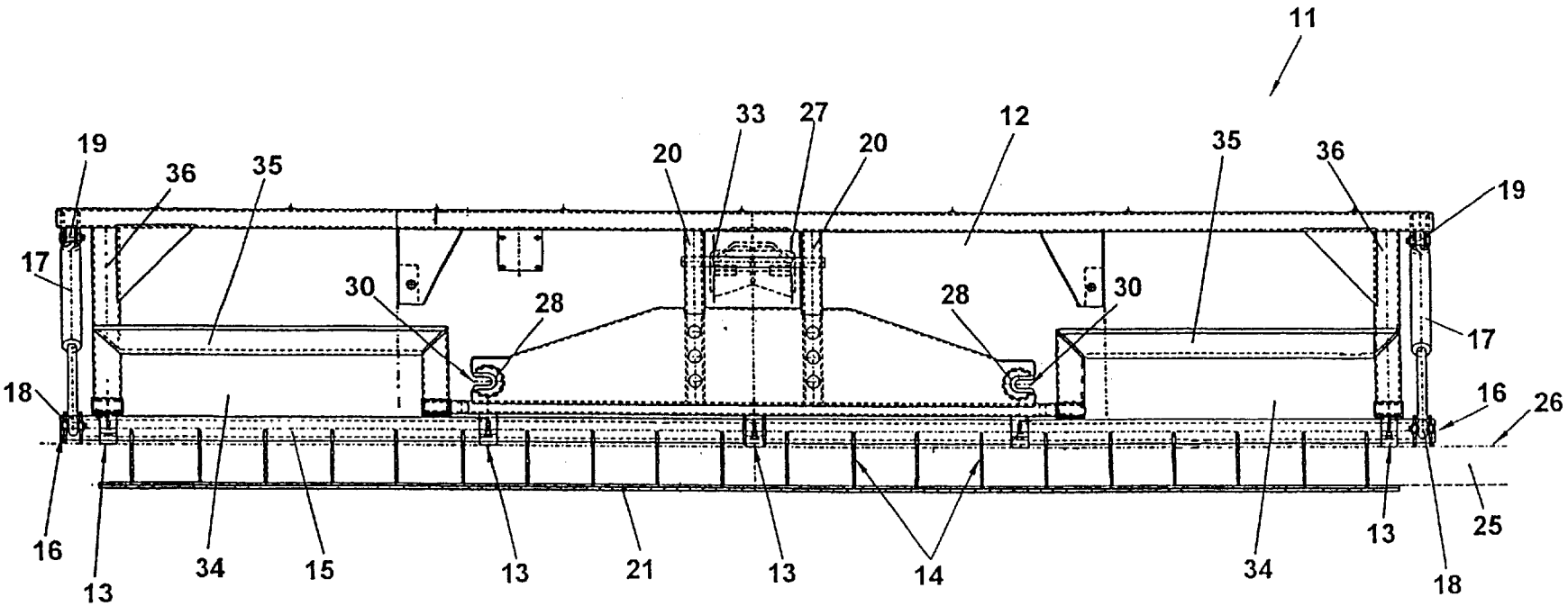
FIG. 4 shows a top view of the rear of the exchangeable adapter according to the invention, as shown in FIG. 3.

FIGS. 3 and 4 show a tiller unit 11 according to the invention, designed as an exchangeable adapter. It has a box-shaped basic body 12 of approximately rectangular cross section, at the bottom of which tiller teeth 14 are pivotably held in a mounting 13. Tiller teeth 14 are rotatably mounted on a shaft 15. The tiller teeth 14 are shown by solid lines indicating their operating position in which they engage more or less vertically in the snow base. The dash-dot lines indicate tiller teeth 14' in ready position, in which they can be tilted back, which means that they are arranged more or less horizontally and do not engage in the snow base.

The rotating shaft 15 is connected to an actuator lever 16 shown in solid lines indicating the operating position, in which it points more or less horizontally backward above the snow base 4, and in dash-dot lines as actuator lever 16' indicating the ready position, in which it points more or less vertically upward.

A piston and cylinder unit which forms control mechanism 17 engages in actuator lever 16. The piston and cylinder unit is arranged via a first linkage point at the outer end of actuator lever 16 and via a second linkage point 19 on a carrier 20 of the tiller unit. The piston and cylinder unit can be connected to a hydraulic system of vehicle 1 via hydraulic lines (not shown).

The tiller teeth are chamfered to a knife edge lengthwise on the side that faces forward when in operating position. Provided at the bottom end of tiller teeth 14 is a cross web 21 which connects tiller teeth 14 with each other. The cross web extends parallel to shaft 15. At its front edge, a knife blade 22 is formed.

In cross section, the cross web in operating position has in the front a substantially horizontal web sector 23 which is followed in the back by a winged web sector 24 that tilts upward. Winged web section 24 is arranged behind the tiller teeth 14.

Cross web 21 separates a snow layer 25 from snow base 4. By means of winged web section 24, this snow layer 25 is slightly lifted and thus loosened up. The dash-dot lines indicates how high the winged web section lifts the snow layer.

Attached to basic body 12 of the exchangeable adapter is a coupling connection of tiller unit 11 for tool carrier 3. Arranged in the middle of the coupling connection is a cross bolt 27 that can engage in hook 6 of tool carrier 3. Correspondingly to locating receptacles 7 of tool carrier 3, locating extensions 28 are formed on the tiller unit, which—together with cross bolt 27—are arranged approximately at the corners of an isosceles triangle. The locating extensions 28 are provided with a central passage hole 29 into which cut 10 extends laterally from the outside. In the back, the locating extensions 28 are set against basic body 12. As an extension of passage hole 29, a receiving hole 31, open toward the front, runs through basic body 12. Receiving hole 31 has a larger diameter than passage hole 29 to which it is concentric. Passage hole 29 and receiving hole 31 are connected with each other in the border wall of basic body 12 by an opening of smaller diameter.

On the side of basic body 12 facing away from locating extensions 28, a retaining arrangement is provided which has the two receiving holes 31 and an open hook element 33 pointing upward. Hook element 33 and receiving hole 31 are arranged in relation to each other exactly as are the locating extensions 28 and cross bolt 27, and as are hook 6 and locating receptacles 7. A conditioning tool, preferably a dozer blade, can be attached to the retaining arrangement. The exchangeable adapter 11 can be attached to tool carrier 3 via cross bolt 27 and locating extensions 28.

In the frontal or rear top view shown in FIG. 4, basic body 12 has a substantially T-shaped form. Cross bolts 27 and locating extensions 28 are arranged in the vertical T member. Open spaces 34 are provided to the left and right horizontally on the outside, next to the locating extensions, below the horizontal T member. These open spaces 34 are provided as spaces in which the piston units of a frontally attached dozer blade with laterally adjustable blades can move.

The rotating axle 15 extends on each side beyond the left and right open spaces 34. To brace shaft 15 in that area, a bracing frame 35 is provided which cantilevers in the back on the basic body and holds the end of shaft 15. This holding point is also met by a retaining carrier 36 which extends vertically downward on the outside from the upper horizontal T member. At the very end of shaft 15, actuator levers 16 and control mechanism 17 are arranged on the left and right.

Figure 5:
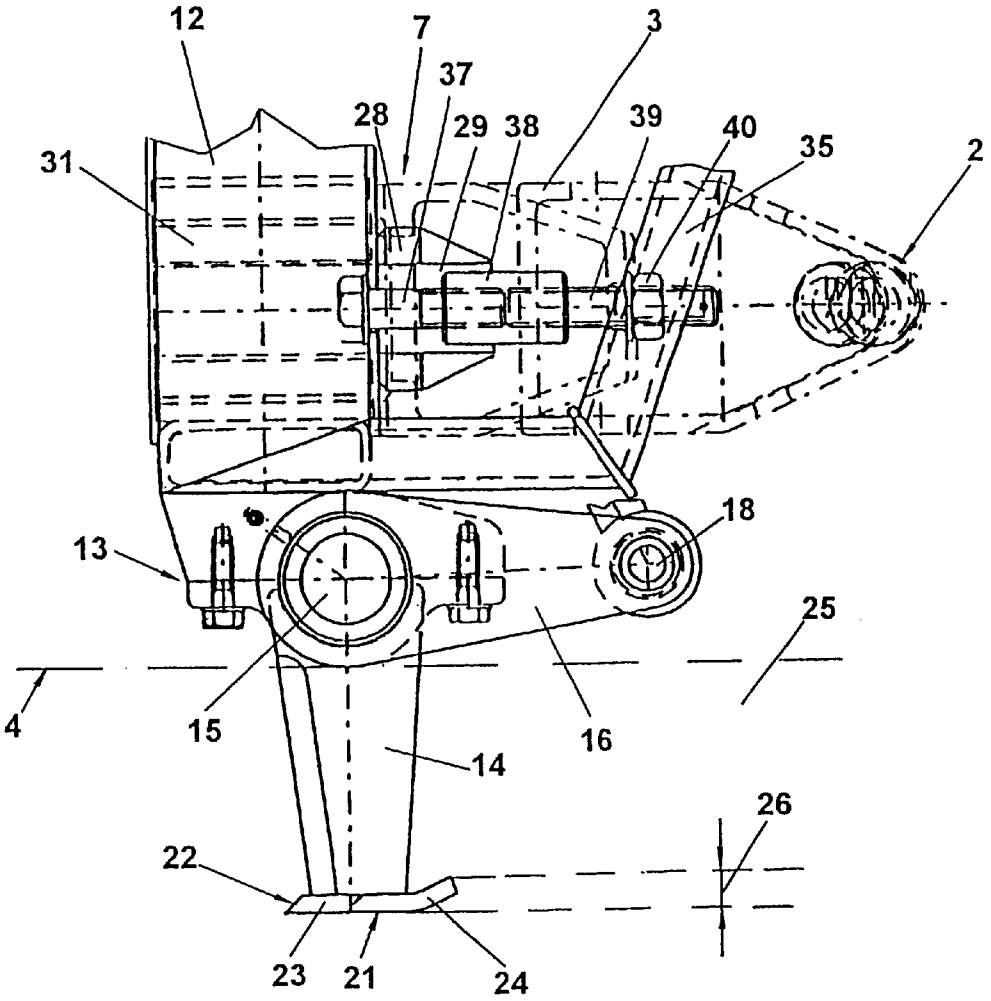
FIG. 5 shows an enlarged view of detail V in FIG. 3.

FIG. 5 shows how exchangeable adapter 11 is attached to the tool carrier via locating extensions 28. Exchangeable adapter 11 is suspended at hook 6 with the aid of its cross bolt 27. When tool carrier 3 is lifted up with the exchangeable adapter, the locating extensions 28 engage in the locating receptacles 7 and are centred at locating holes 8, as shown in FIG. 5. The locating extensions 28 extend into the pot-shaped locating receptacles 7. Pushed through hole 32 from receiving hole 31 is a screw 37 whose head is supported at the edges of hole 32. Screwed onto the screw is a threaded sleeve 38 which on the other side is screwed into a threaded bolt 39. Threaded bolt 39 extends beyond locating receptacle 7. At its end, it is provided with a nut 40 which is supported by locating receptacle 7. Thus, the exchangeable adapter is attached in an easily removable manner to locating receptacle 7, and as an adapter unit, it is also easy to remove again from it.

Figure 7:
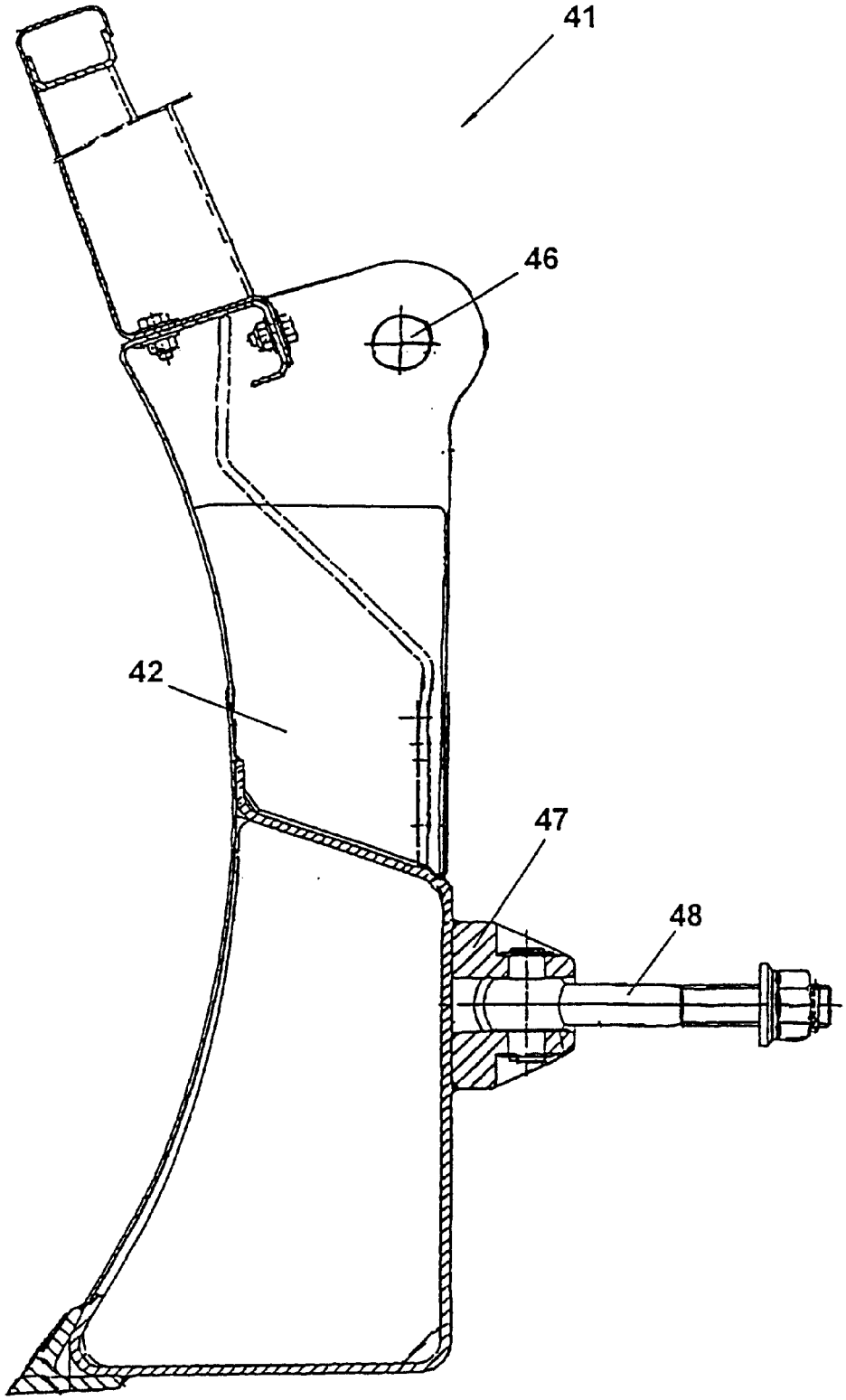
FIG. 7 shows a vertical section through a dozer blade according to the invention in accordance with the first embodiment, along line VII—VII in FIG. 8.
Figure 8:
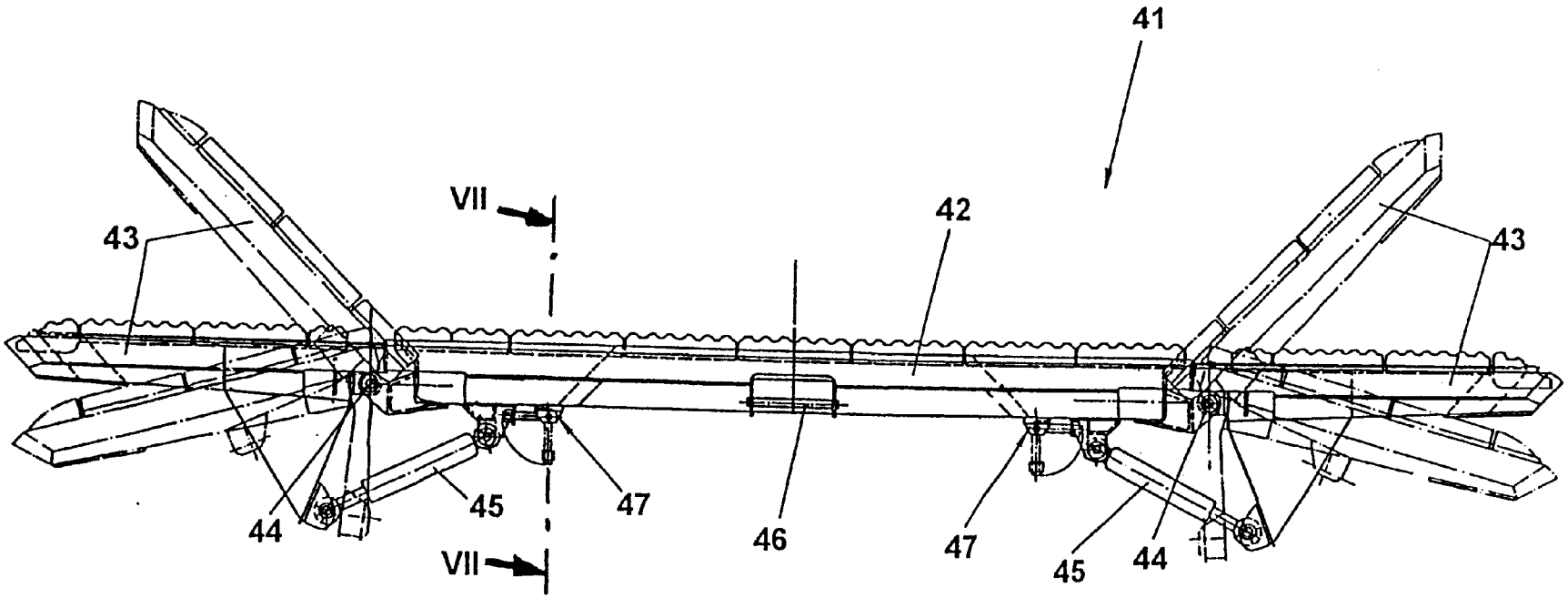
FIG. 8 shows a straight top view of the dozer blade shown in FIG. 7.

To tiller unit 11 or directly to tool carrier 3, a dozer blade 41 can be coupled as a conditioning tool, which is shown in FIG. 7 and 8. Dozer blade 41 has a central dozing body 42 which is concave towards the front. On the side of dozer body 42, movable dozer vanes 43 are provided. Each dozer vane is pivotably mounted to dozer body 42 via a vertical rotating axle 44 and each vane is movable between the front and back positions shown in FIG. 8 by a dash-dot line. Adjustment is accomplished via hydraulic pistons 45 which are linked between dozer body 42 and each dozer blade 43. The hydraulic pistons can move into open spaces 34 of the tiller unit when the dozer blade is attached to the tiller unit.

In the middle of dozer body 42, a cross bolt 46 is provided. Cross bolt 46 is part of a coupling connection of dozer blade 41, which is also provided with two locating necks 47 on the back of the dozer blade. In reference to cross bolt 46, locating necks 47 are positioned to match the position of hook 6 and locating receptacle 7 of tool carrier 3. They, together with cross bolt 46, therefore lie at the corners of an isosceles triangle.

Attached to locating necks 47 are screw bolts 48 which are horizontally pivotable, as shown in FIG. 7 and 8. For example, dozer blade 41 can be coupled directly to tool carrier 3 in which hook 6 grasps under cross bolt 46, whereby the locating necks 47 are centred through locating holes 8 in locating receptacles 7 when dozer blade 41 is raised. Then, screw bolts 48 can be placed from outside through cuts 10 into holes 9, whereby a nut 40 is supported at the edges of holes 9 so that dozer blade 41 can be releasably locked at tool carrier 3.

Figure 6:
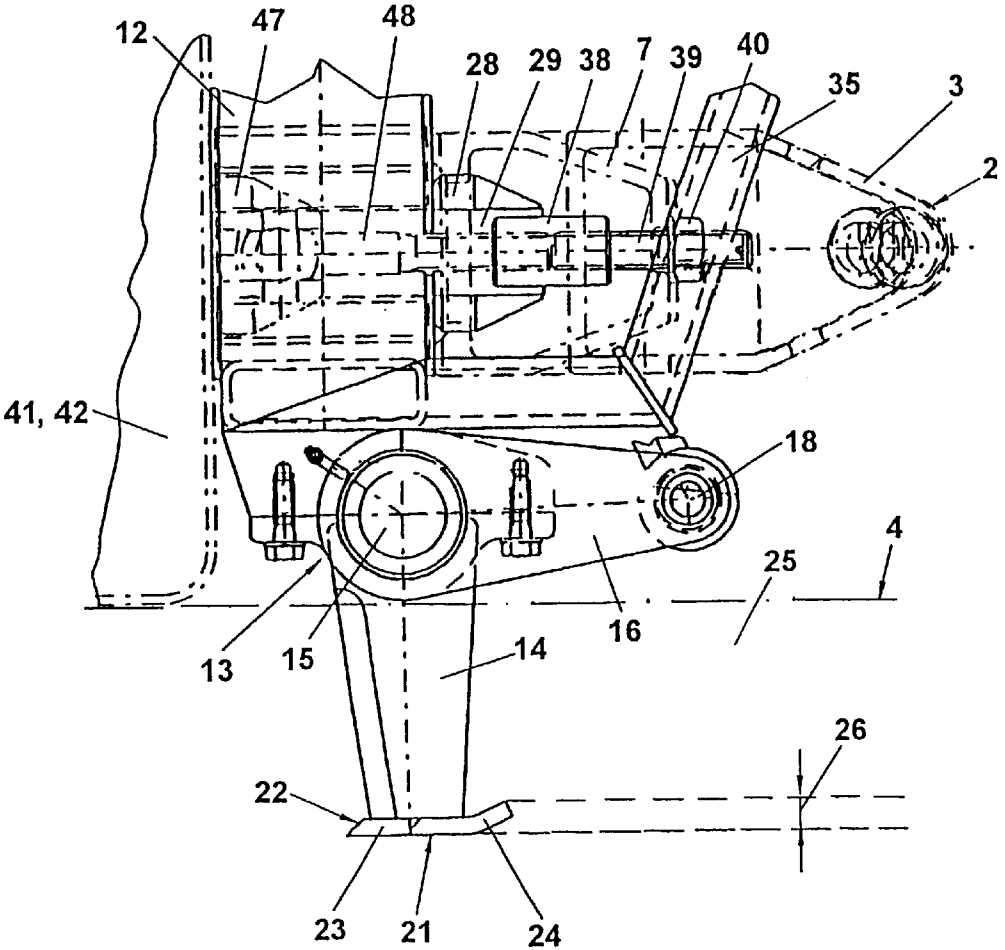
FIG. 6 shows an enlarged view of detail V of the exchangeable adapter of FIG. 3, with the dozer blade and the multi-articulated mounting only indicated.

FIG. 6 shows a partial view in which the exchangeable adapter 11 is attached directly to tool carrier 3, and dozer blade 41 is held directly on the exchangeable adapter. Cross bolt 46 of the dozer blade is accommodated by hook element 33. Locating necks 47 are accommodated in receiving holes 31 and are centered in same. Screw bolts 48 are laterally tilted through cuts 30 into receiving hole 31, and hole 32 is tilted and extends into passage hole 32. The end of screw bolt 39 is provided with a threaded sleeve 38 which connects it to a threaded bolt 39 which catches behind locating receptacle 7 via a nut 40. Locating extensions 28 engage in locating receptacles 7. Thus, the dozer blade and exchangeable adapter 11 are centered with regard to each other and to tool carrier 3 and releasably fastened. Tiller unit 11 serves as an exchangeable adapter.

Figure 9:
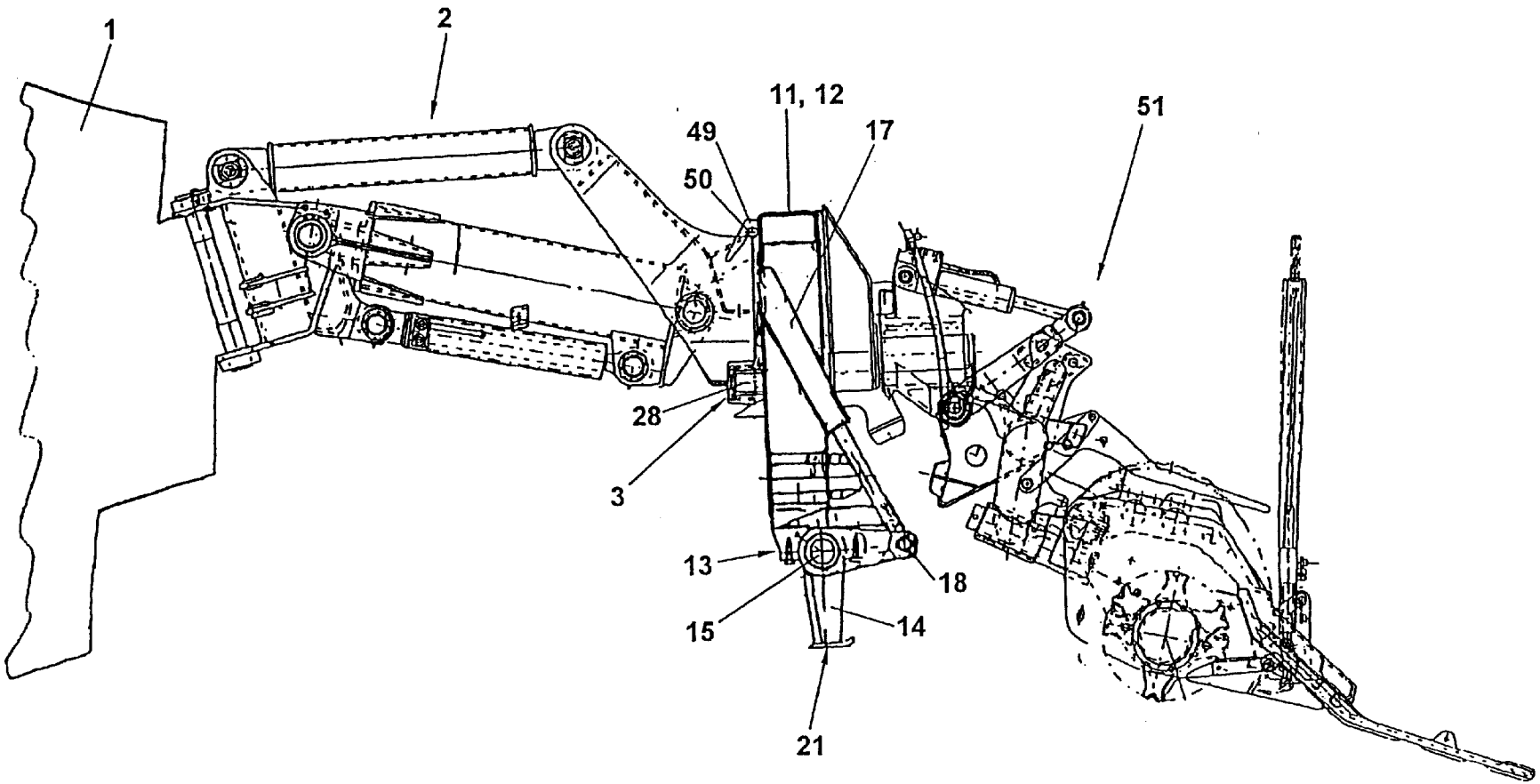
FIG. 9 shows second embodiment of a snow grooming device according to the invention, attached behind a snow grooming vehicle.

FIG. 9 shows a second embodiment of a snow grooming device according to the invention. A multi-articulated mounting 2 is attached behind a snow grooming vehicle. Multi-articulated mounting 2 carries a tool carrier 3. a tiller unit 11 is coupled to tool carrier 3 as an exchangeable adapter, which corresponds substantially to the tiller unit described above. The coupling elements between tool carrier 3 and tiller unit 11 approximately corresponds to the coupling elements described with regard to the first embodiment.

One change concerns the design of the hook connection. A hook 49 is attached to the upper part of tiller unit 11 approximately in the middle over the transverse side and reaches across a cross bolt 50 fastened to tool carrier 3. The other coupling elements corresponds approximately to the coupling elements described with regard to the first embodiment. It is understood that the locating extensions can also be provided at tool carrier 3, in which case locating receptacles 7 are fastened to the tiller unit.

On the opposite side, an auger 51 is attached as the conditioning tool, and it is pulled behind the vehicle. Auger 51 is held by tiller unit 11. The coupling connection between auger 51 and tiller unit 11 corresponds to the coupling connection between tiller unit 11 and tool carrier 3 described above. Optionally, auger 51 can also be attached to tool receptacle 3 without having tiller unit 11 between them. In exactly the same manner, the tiller unit can be coupled to tool carrier 3 alone, without using auger 51.

The effect and function of the embodiments of the snow grooming device according to the invention are described in detail below.

Tiller unit 11 can be directly attached as an exchangeable adapter to tool carrier 3 of vehicle 1. In this case, tiller unit 11 is designed as a unit separate from the conditioning tool and as an exchangeable adapter. Now, the conditioning tool can be coupled to exchangeable adapter 11.

Since the tiller unit is designed as a separate exchangeable adapter 11, it can also be uncoupled from tool carrier 3, and a conditioning tool can be attached directly to tool carrier 3. This allows the combined use of the tiller unit and the conditioning tool, the sole use of the tiller unit, and the sole use of the conditioning tool. The devices can be mounted on the vehicle by means of a simple coupling procedure.

What is claimed is:

1. A snow grooming device which can be attached to a tool carrier (3) in the front or back of a vehicle (1), which is provided with a snow conditioning tool (41, 51) that can be coupled to the tool carrier, and which is provided with a tiller unit (11) on a same side of the vehicle (1), characterized in that the tiller unit (11) is designed as an exchangeable adapter separate from the conditioning tool (41, 51) and can be attached to the vehicle (1) and uncoupled from it, characterized in that the tiller unit (11) is designed as a holder for the conditioning tool (41, 51).

2. A snow grooming device which can be attached to a tool carrier (3) in the front or back of a vehicle (1), which is provided with a snow conditioning tool (41, 51) that can be coupled to the tool carrier, and which is provided with a tiller unit (11) on a same side of the vehicle (1), characterized in that the tiller unit (11) is designed as an exchangeable adapter separate from the conditioning tool (41, 51) and can be attached to the vehicle (1) and uncoupled from it, characterized in that the tiller unit (11) has a coupling connection (27, 28) for the tool carrier (3) on the side facing the vehicle and a holding means (33, 31) for the conditioning tool (41, 51) on the side facing away from the vehicle.

3. A snow grooming device which can be attached to a tool carrier (3) in the front or back of a vehicle (1), which is provided with a snow conditioning tool (41, 51) that can be coupled to the tool carrier, and which is provided with a tiller unit (11) on a same side of the vehicle (1), characterized in that the tiller unit (11) is designed as an exchangeable adapter separate from the conditioning tool (41, 51) and can be attached to the vehicle (1) and uncoupled from it, characterized in that the tiller unit (11) has tiller teeth (14) which can be moved via a control mechanism (17) from a ready position to an operating position, in which the teeth (14) engage in the snow base (4), whereby the control mechanism (17) is integrated in the tiller unit (11).

4. The snow grooming device according to claim 3, characterized in that the control mechanism (17) is attached to an actuator lever (16) separate from the tiller teeth (14).

5. The snow grooming device according to claim 3, characterized in that the control mechanism (17) is provided with a piston and cylinder unit whose linkage points (18, 19) are provided on the tiller unit (11).

6. A snow grooming device which can be attached to a tool carrier (3) in the front or back of a vehicle (1), which is provided with a snow conditioning tool (41, 51) that can be coupled to the tool carrier, and which is provided with a tiller unit (11) on a same side of the vehicle (1), characterized in that the tiller unit (11) is designed as an exchangeable adapter separate from the conditioning tool (41, 51) and can be attached to the vehicle (1) and uncoupled from it, characterized in that the tiller unit (11) has several tiller teeth (14) which are connected with each other via a cross web (21) extending along a transverse direction with respect to the tiller unit (11), which cross web (21) engages into the snow base (4) when the teeth are in operating position.

7. The snow grooming device according to claim 6, characterized in that the cross web (21) connects the several tiller teeth (11) at outer ends thereof.

8. The snow grooming device according to claim 6, characterized in that the cross web (12) extends parallel to a rotating shaft (15) of the tiller teeth (14).

9. A snow grooming device which can be attached to a tool carrier (3) in the front or back of a vehicle (1), which is provided with a snow conditioning tool (41, 51) that can be coupled to the tool carrier, and which is provided with a tiller unit (11) on a same side of the vehicle (1), characterized in that the tiller unit (11) is designed as an exchangeable adapter separate from the conditioning tool (41, 51) and can be attached to the vehicle (1) and uncoupled from it, characterized in that the conditioning tool is a dozer blade (41).

10. A snow grooming device which can be attached to a tool carrier (3) in the front or back of a vehicle (1), which is provided with a snow conditioning tool (41, 51) that can be coupled to the tool carrier, and which is provided with a tiller unit (11) on a same side of the vehicle (1), characterized in that the tiller unit (11) is designed as an exchangeable adapter separate from the conditioning tool (41, 51) and can be attached to the vehicle (1) and uncoupled from it, characterized in that the conditioning tool is an auger (51).

* * * * *

UNITED STATES PATENT AND TRADEMARK OFFICE

CERTIFICATE OF CORRECTION

PATENT NO. : 6,481,123 B1 
DATED : November 19, 2002
INVENTOR(S) : Helmut Kanzler and Gerd Friedman It is certified that error appears in the above-identified patent and that said Letters Patent is hereby corrected as shown below:

Title page,
Item [73], Assignee, delete "Kassbohrer Glandefahrzeug AG" and insert instead -- Kässbohrer Geländefahrzeug AG --.

Signed and Sealed this

Second Day of December, 2003

JAMES E. ROGAN
*Director of the United States Patent and Trademark Office*